US006908396B1

(12) United States Patent
Billig

(10) Patent No.: US 6,908,396 B1
(45) Date of Patent: Jun. 21, 2005

(54) METHOD FOR CONSTRUCTING A RACE TRACK FOR REMOTE CONTROL TOY VEHICLES AND APPARATUS THEREFOR

(76) Inventor: John M. Billig, 5246 Carmento Dr., Oak Park, CA (US) 91377

( * ) Notice: Subject to any disclaimer, the term of this patent is extended or adjusted under 35 U.S.C. 154(b) by 0 days.

(21) Appl. No.: 10/897,142

(22) Filed: Jul. 22, 2004

Related U.S. Application Data

(60) Provisional application No. 60/490,610, filed on Jul. 26, 2003.

(51) Int. Cl.[7] ..... A63K 1/00
(52) U.S. Cl. ..... 472/85; 472/89
(58) Field of Search ..... 472/85–89; 446/124, 446/125; 105/4.1; 238/10 E, 10 F

(56) References Cited

U.S. PATENT DOCUMENTS

| | | | | |
|---|---|---|---|---|
| 3,395,861 | A * | 8/1968 | Kindred | 238/10 R |
| 3,729,133 | A * | 4/1973 | Covert | 238/10 E |
| 3,885,502 | A * | 5/1975 | Sarno et al. | 104/53 |
| 3,930,647 | A * | 1/1976 | Berlemont | 472/89 |
| 4,231,294 | A * | 11/1980 | Arzoumanian | 104/138.1 |
| 5,215,490 | A * | 6/1993 | Szoradi | 446/115 |
| 5,746,038 | A * | 5/1998 | Houk | 52/590.1 |

* cited by examiner

*Primary Examiner*—Kien Nguyen
(74) *Attorney, Agent, or Firm*—Ted Masters

(57) ABSTRACT

A race track for remote control toy vehicles includes a plurality of interlocking race track segments of several different configurations. Each race track segment includes a removable side rail. The race track is arranged so that the perimeter of the race track is completely bordered by side rails. As such, the remote control toy vehicles are contained within the race track. Three race track surfaces are provided to simulate various racing conditions.

15 Claims, 5 Drawing Sheets

METHOD FOR CONSTRUCTING A RACE TRACK FOR REMOTE CONTROL TOY VEHICLES AND APPARATUS THEREFOR

CROSS REFERENCE TO RELATED APPLICATION

This application claims the filing benefit under 35 U.S.C. §119(e) of U.S. Provisional Application No. 60/490,610, filed Jul. 26, 2003, which is included herein by reference.

TECHNICAL FIELD

The present invention pertains generally to foam race tracks for racing remote control toy vehicles, and more particularly to foam race tracks with foam side borders which both keep the vehicles from exiting the race track and prevent damage to the vehicles.

BACKGROUND OF THE INVENTION

Foam race tracks for remote control toy vehicles are known in the art. Such race tracks comprise a surface of interlocking polymer foam track sections upon which the remote control vehicles freely travel. In the existing race tracks however, there is no mechanism for keeping the vehicles on the racing surface. As such, the vehicles oftentimes leave the racing surface sometimes inflicting damage to the vehicles.

BRIEF SUMMARY OF THE INVENTION

The present invention is directed to a modular race track for remote control toy vehicles. The race track includes a plurality of interlocking polymer foam mats having soft side foam rails. The race track sections include different side rail configurations such as straight rail, inside corner, outside corner, and side bump rail. The sections can be assembled by a user to form a variety of different race track layouts. The race track is set up so that the entire periphery of the race track is guarded by side rails so that the remote control toy vehicles cannot leave the race track. The side rails both prevent the remote control vehicles from leaving the race track, and can also serve to guide the vehicles upon the race track by forming a central barrier. The present invention gives the user a product which won't damage or scratch most toy plastic vehicles and will keep most small remote control vehicles from exiting the track when in contact with a side border. The different track configuration pieces allow each user to create his or her own custom track layout. The track sets up very easily and can be stored in a very small space. The material of the track can hold up to most weather related exposures. Different track surface textures include an off road bumpy surface, a smooth flat surface, and a roughened friction enhancing surface. It may be appreciated that the track sections of the present invention may be sold separately, or may be sold in a kit which can be configured into one or more race track layouts.

In accordance with a preferred embodiment of the invention, a method for constructing a race track for remote control toy vehicles includes the steps of:

(a) providing a plurality of interlockable mats, each mat having a top surface;

(b) providing a corresponding plurality of side rails, a side rail attached to the top surface of each mat and extending upwardly therefrom, each side rail and mat pair forming a race track segment; and, (c) arranging the race track segments by interlocking the mats to form a race track, the arrangement being made such that the perimeter of the race track is completely bordered by side rails.

In accordance with an aspect of the invention:

in (b), a first configuration race track segment including:

a mat having three interlockable sides and one straight side;

a straight side rail disposed along the straight side of the mat; and, the first configuration race track segment positionable along either the perimeter of the race track or in the interior of the race track.

In accordance with another aspect of the invention:

in (b), a second configuration race track segment including:

a mat having three interlockable sides and one straight side;

a convex side rail disposed along the straight side of the mat; and, the second configuration race track segment positionable along either the perimeter of the race track or in the interior of the race track.

In accordance with another aspect of the invention:

in (b), a third configuration race track segment including:

a mat having two perpendicular interlockable sides and a quarter circle side;

a curved side rail disposed along the quarter circle side of the mat; and, the third configuration race track segment only positionable along the perimeter of the race track.

In accordance with another aspect of the invention:

in (b), a fourth configuration race track segment including:

a mat having four interlockable sides and four corners;

a quarter circle side rail which is disposed in one of the corners of the mat; and, the fourth configuration race track segment only positionable in the interior of the race track.

In accordance with another aspect of the invention:

in (b), a fifth configuration race track segment including:

a mat being having four interlockable sides;

a straight side rail disposed along a central axis of the mat; and, the fifth configuration race track segment only positionable in the interior of the race track.

In accordance with another aspect of the invention:

in (b), the side rails removably attached to the mats.

In accordance with another aspect of the invention:

in (a), each mat having at least one hole;

in (b), each side rail having at least one hole; and, in (b), a connector received by the at least one hole in the mat and the at least one hole in the side rail, the connector removably connecting each side rail to each mat.

In accordance with another aspect of the invention:

in (b), each side rail having a first end and an opposite second end;

in (b), the first end of each side rail interlockable with an adjacent side rail, and the second end of each side rail interlockable with another adjacent side rail;

in (b), interlocking the first end of each side rail with an adjacent side rail; and, in (b), interlocking the second end of each side rail with another adjacent side rail.

In accordance with another aspect of the invention:

the top surface having a texture, the texture being one of (1) smooth, (2) roughened, and (3) bumpy.

In accordance with another aspect of the invention:

each of the mats having a bottom surface having a texture, the texture being one of (1) smooth, (2) roughened, and (3) bumpy; and, the texture of the bottom surface being different from the texture of the top surface.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
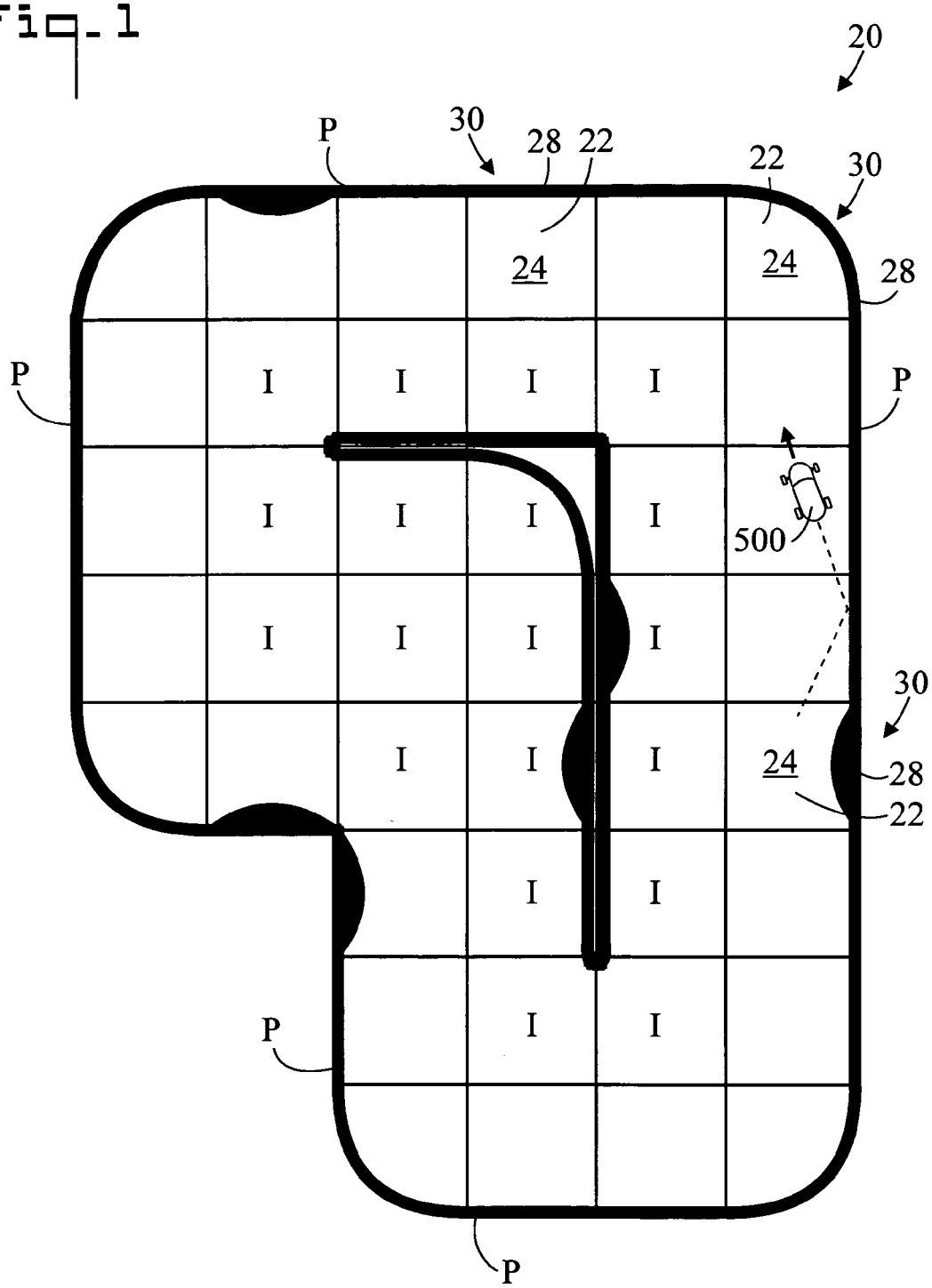
FIG. 1 is a reduced top plan view of a rack track for remote control toy vehicles in accordance with the present invention.

Referring initially to FIG. 1, there is illustrated a reduced top plan view of a rack track for remote control toy vehicles 500 in accordance with the present invention, generally designated as 20. Race track 20 includes a plurality of interlocking mats 22, each mat 22 has a top surface 24. In an embodiment of the invention mats 22 are approximately 50 cm×50 cm and have a thickness T of about 14 mm (refer to FIG. 7). Also in an embodiment of the invention, mats 22 are fabricated from a polymer foam such as ethylene vinyl acetate (EVA). Mats 22 have borders which have teeth 26 which interlock with adjacent mats (refer to FIGS. 2–5, 12, and 15). In FIG. 1, for simplicity the interlocking teeth 26 have been omitted. Top surface 24, and bottom surface 25 (refer to FIG. 16) can have one of three surface textures (refer also to FIG. 16 and the discussion pertaining thereto).

A side rail 28 (shown by wide dark line) is attached to top surface 24 of each mat 22 and extends upwardly therefrom, each side rail 28 and mat 22 pair forming a race track segment 30 (refer also to FIGS. 6–11, and 13). In a preferred embodiment of the invention, side rails 28 are removably attached to mats 22. It is noted that race track segments 30 come in different mat 22 and side rail 28 configurations (refer to FIGS. 6–11, and 13). In an embodiment of the invention, side rails 28 have a height H of about 3 cm (refer to FIG. 7).

Race track segments 30 are arranged so that race track 20 has a perimeter P which is completely bordered by side rails 28. As such, when a remote control toy vehicle 500 contacts a side rail 28, because of the side rails height H, the vehicle 500 is deflected away from the side rail 28 and back toward the interior of race track 20.

Figure 2:
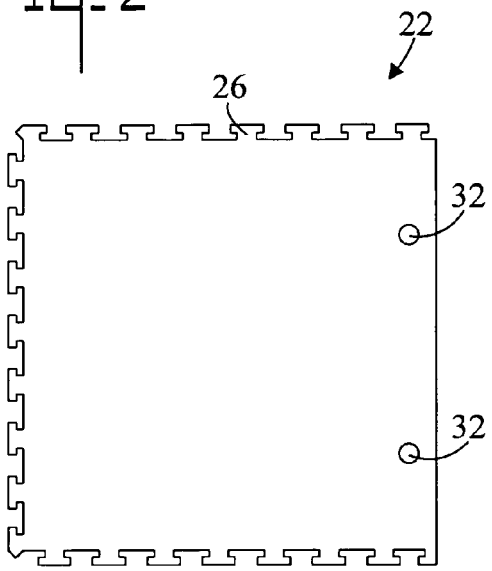
FIG. 2 is a top plan view of a first type of mat.

Now referring to FIGS. 2–5, there are illustrated top plan views of first through fourth types of mats 22. As may be seen from FIG. 1, each type of mat is useful for constructing a particular portion of race track 20. FIG. 2 is a first type of mat 22 which has three interlockable sides and one straight side. First type of mat 22 is used create the first configuration race track segment 30 shown in FIG. 6. First type of mat 22 has two holes 32 which receive connectors 50 (refer to FIG. 14) that attach a side rail 28 to a mat 22. It is noted that each mat 22 has at least one hole 32 for connecting its associated side rail 28.

Figure 3:
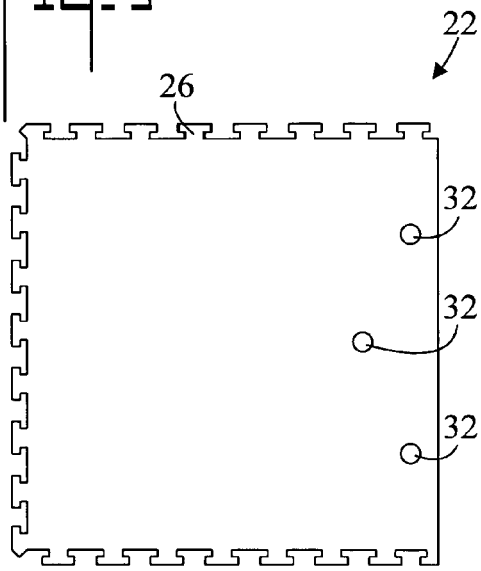
FIG. 3 is a top plan view of a second type of mat.

FIG. 3 is a second type of mat 22 which has three interlockable sides and one straight side. Second type of mat 22 is used create the second configuration race track segment 30 shown in FIG. 8. Second type of mat 22 has three holes 32 which receive connectors 50 (refer to FIG. 14) that attach a convex side rail 28 to a mat 22.

Figure 4:
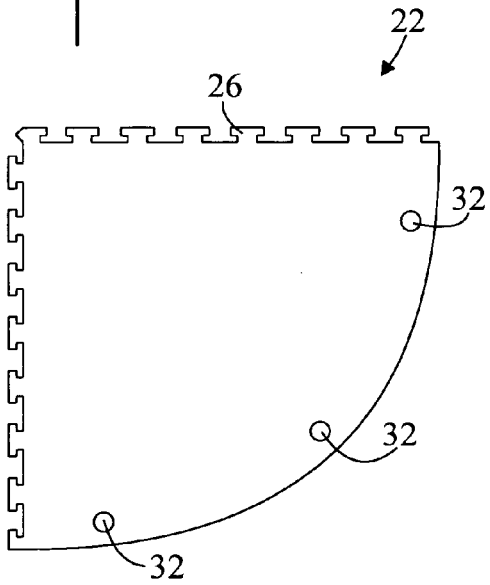
FIG. 4 is a top plan view of a third type of mat.

FIG. 4 is a third type of mat 22 which has two interlockable sides and a quarter circle side. Third type of mat 22 is used create the third configuration race track segment 30 shown in FIG. 10. Third type of mat 22 has three holes 32 which receive connectors 50 (refer to FIG. 14) that attach a quarter circle side rail 28 to a mat 22.

Figure 5:
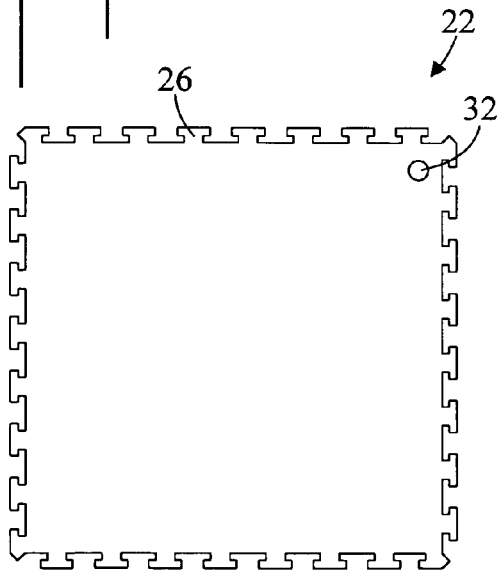
FIG. 5 is a top plan view of a fourth type of mat.

FIG. 5 is a fourth type of mat 22 which has four interlockable sides. Fourth type of mat 22 is used create the fourth configuration race track segment 30 shown in FIG. 11. Fourth type of mat 22 has one hole 32 which receives a connector 50 (refer to FIG. 14) that attaches a quarter circle side rail 28 to a mat 22.

Figure 6:
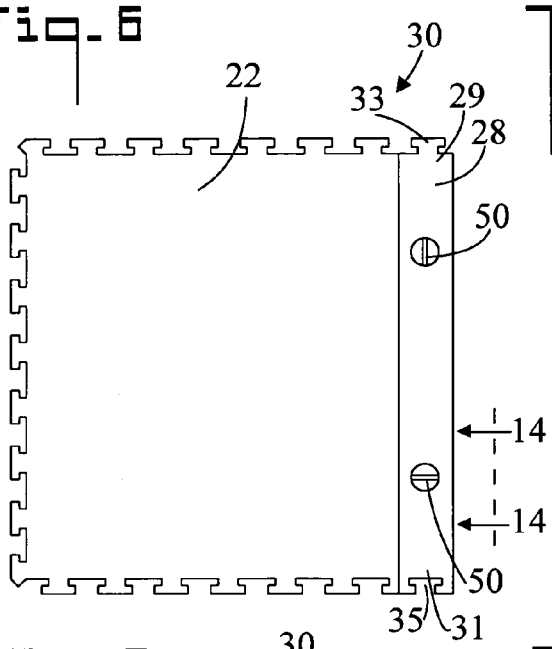
FIG. 6 is a top plan view of a first configuration race track segment.

Referring now to FIG. 6, there is illustrated a top plan view of a first configuration race track segment 30. Mat 22 is substantially square and has three interlockable sides (sides that selectively interlock with an adjacent race track segment 30) and one straight side. Side rail 28 is straight and is disposed along the straight side of mat 22. Two connectors 50 attach side rail 28 to mat 22. First configuration race track segment 30 is positionable along either the perimeter P of race track 20 or in the interior I of race track 20. The interior of race track 20 is defined as any mat 22 which does not define the perimeter P of race track 20. For example, selected race track segments 30 designated with an I in FIG. 1 comprise the interior of race track 20.

Figure 7:
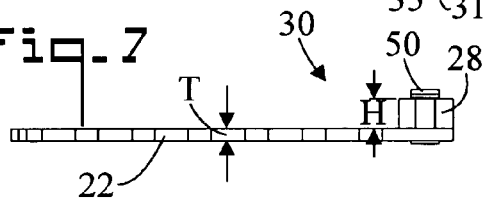
FIG. 7 is a side elevation view of the first configuration race track segment.

FIG. 7 is a side elevation view of the first configuration race track segment 30. Mat 22 has a thickness T, and side rail 28 has a height H.

Figure 8:
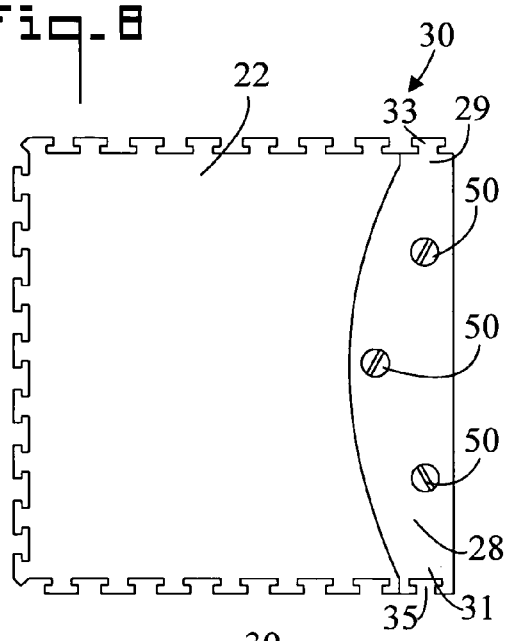
FIG. 8 is a top plan view of a second configuration race track segment.

Referring now to FIG. 8, there is illustrated a top plan view of a second configuration race track segment 30. Mat 22 is substantially square and has three interlockable sides and one straight side. Side rail 28 is convex and is disposed along the straight side of mat 22. Three connectors 50 attach side rail 28 to mat 22. Second configuration race track segment 30 is positionable along either the perimeter P of race track 20 or in the interior I of race track 20. Second configuration race track segment 30 serves as a "bumper" for the toy vehicles 500.

Figure 9:
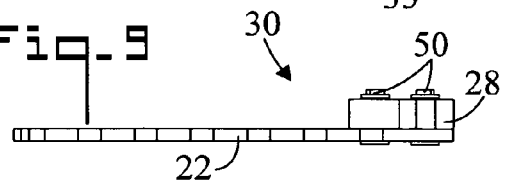
FIG. 9 is a side elevation view of the second configuration race track segment.

FIG. 9 is a side elevation view of the second configuration race track segment 30.

Figure 10:
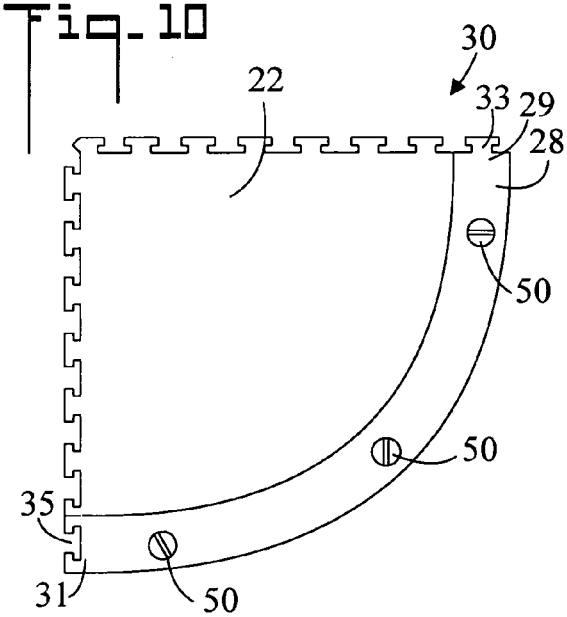
FIG. 10 is a top plan view of a third configuration race track segment.

Referring now to FIG. 10, there is illustrated a top plan view of a third configuration race track segment 30. Mat 22 has two perpendicular interlockable sides and a quarter circle side. Side rail 28 is curved and disposed along the quarter circle side of mat 22 forming a curved outside corner. Three connectors 50 attach side rail 28 to mat 22. Third configuration race track segment 30 is only positionable along the perimeter P of race track 20 at a corner of the race track 20.

Figure 11:
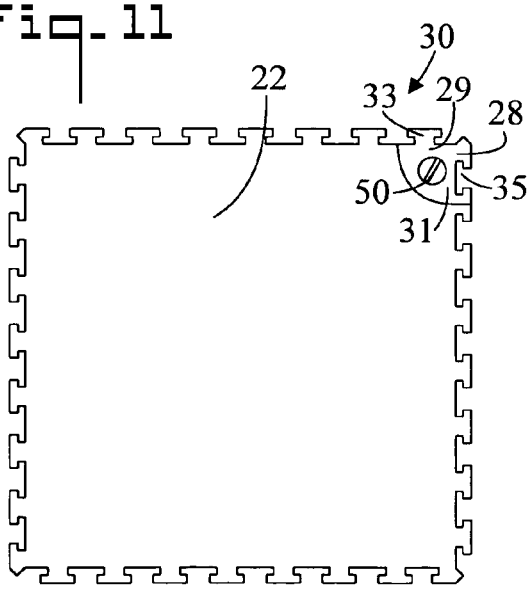
FIG. 11 is a top plan view of a fourth configuration race track segment.

Referring now to FIG. 11, there is illustrated a top plan view of a fourth configuration race track segment 30. Mat 22 is substantially square and has four interlockable sides and four corners. Side rail 28 is a quarter circle (inside corner) and is disposed in one of the corners of mat 22. One connector 50 attaches side rail 28 to mat 22. Fourth configuration race track segment 30 is only positionable in the interior I of race track 20.

Figure 12:
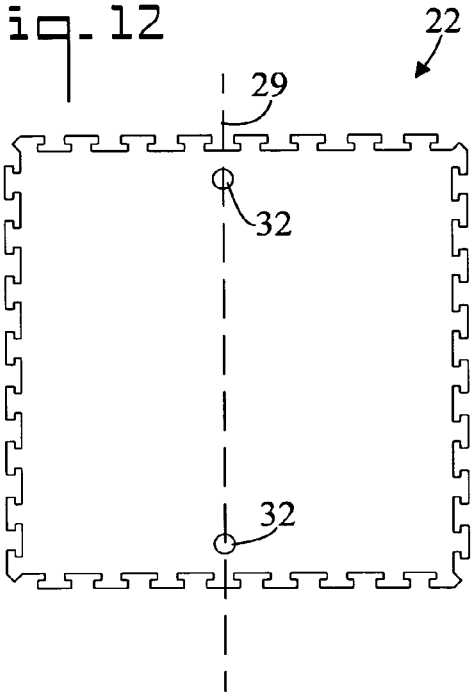
FIG. 12 is a top plan view of a fifth type of mat.

FIG. 12 is a top plan view of a fifth type of mat 22 which has four interlockable sides. Fifth type of mat 22 is used create the fifth configuration race track segment 30 shown in FIG. 13. Fifth type of mat 22 has two holes 32 disposed on a central axis 29 which receive connectors 50 (refer to FIG. 14) that attach a side rail 28 to a mat 22.

Figure 13:
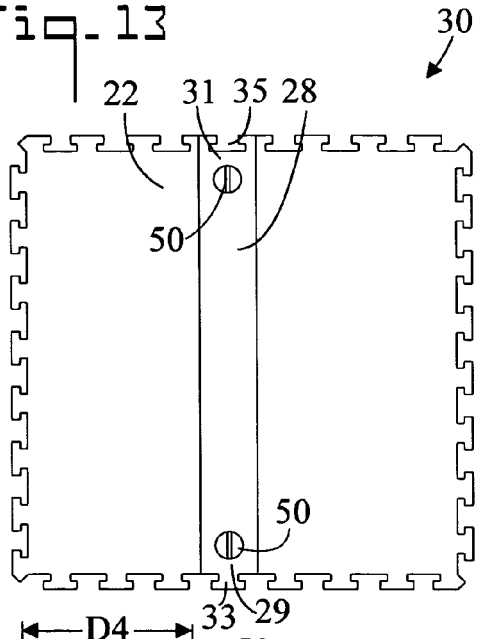
FIG. 13 is a top plan view of a fifth configuration race track segment.

Referring now to FIG. 13, there is illustrated a top plan view of a fifth configuration race track segment 30. Mat 22 is substantially square and has four interlockable sides and a central axis 29. Side rail 28 is straight and is disposed along central axis 29 of mat 22. Two connectors 50 attach side rail 28 to mat 22. Fifth configuration race track segment 30 is only positionable in the interior I of race track 20 (refer to FIG. 17).

It is noted that in FIGS. 6, 8, 10, 11, and 13 each side rail 28 has a first end 29 and an opposite second end 31. Each first end 29 of each side rail 28 is interlockable with an adjacent side rail 28, and each second end 31 of each side rail 28 is interlockable with another adjacent side rail 28. In the shown embodiment, first ends 29 have a tooth 33, and second ends 31 have a tooth-receiving cavity 35.

Figure 14:
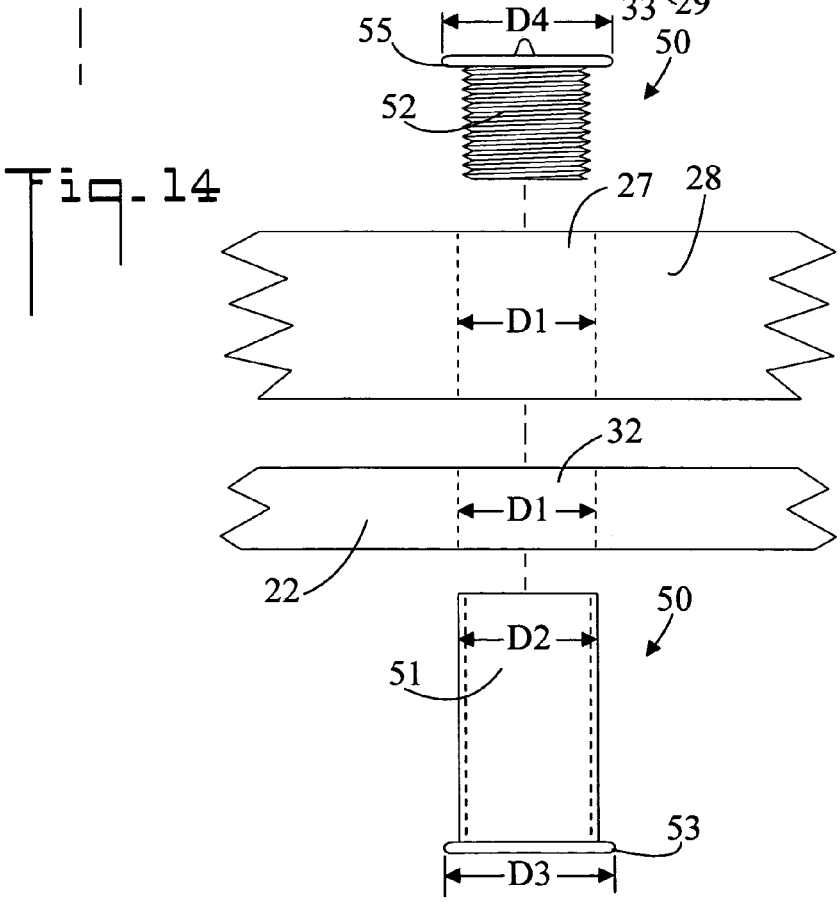
FIG. 14 is an enlarged exploded side elevation view in direction 14—14 of FIG. 6.

FIG. 14 is an enlarged exploded side elevation view in direction 14—14 of FIG. 6. Each mat 22 has at least one hole 32, and each side rail 28 has at least one corresponding hole 27. Connector 50 is received by the at least one hole 32 in mat 22 and hole 27 in side rail 28. Holes 32 and 27 have a first diameter D1. Connector 50 includes a first member 51 having a hollow cylindrical body having female threads, the body having an outside second diameter D2 which is approximately equal to first diameter D1 of holes 32 and 27. In an embodiment of the invention, connector 50 is plastic. First member 51 has a closed end having a first flange 53 having a third diameter D3 which is greater than first diameter D1. Connector 50 includes a second member 52 having male threads which selectively engage the female threads of first member 51. Second member 52 has a second flange 55 having a fourth diameter D4 which is also greater than first diameter D1. Wherein first member 51 may be inserted through holes 32 and 28 of mat 22 and side rail 28 respectively, and the male and female threads engaged and tightened so that first 53 and second 55 flanges abut mat 22 and side rail 28 respectively.

Figure 15:
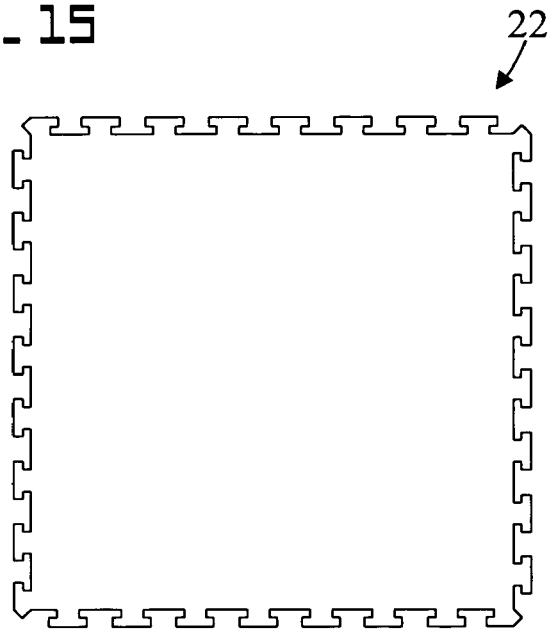
FIG. 15 a top plan view of a sixth type of mat.

FIG. 15 a top plan view of a sixth type of mat 22. This type of mat 22 has no holes, and can only be used in the interior I of race track 20.

Figure 16:
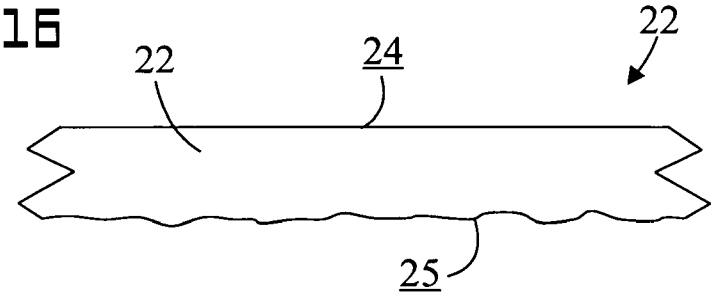
FIG. 16 is an enlarged side elevation view of a mat having two different racing surfaces; and, FIG. 17 is a reduced top plan view of a second rack track configuration.

FIG. 16 is an enlarged side elevation view of a mat 22 having two different racing surfaces. Top surface 24 of mat 22 can have one of a three different textures, (1) smooth (shown in the FIG.), (2) roughened, and (3) bumpy. The smooth texture is useful for most toy vehicles. The bumpy texture which is useful for off-road vehicles. The roughened surface is a smooth surface which has been scraped with a blade to roughen the surface and thereby provide better traction for the toy vehicles.

Each mat 22 also has a bottom surface 25 having a texture, the bottom texture also being one of (1) smooth, (2) roughened, and (3) bumpy (shown in the FIG.). In an embodiment of the invention, the bottom surface 25 texture is different from the top surface 24 texture. This feature allows one set of mats 22 to be reversed and therefore provide two different racing surfaces.

Figure 17:
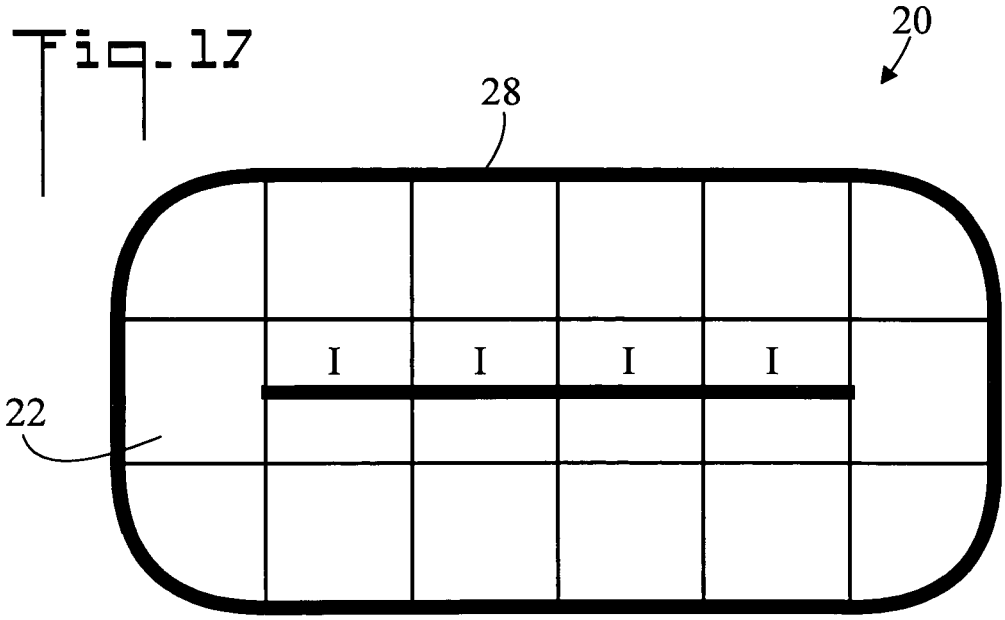

FIG. 17 is a reduced top plan view of a second rack track 20 configuration.

In terms of use, a method for constructing a race track 20 for remote control toy vehicles 500, includes:

(a) providing a plurality of interlockable mats 22, each mat 22 having a top surface 24;

(b) providing a corresponding plurality of side rails 28, a side rail 28 attached to the top surface 24 of each mat 22 and extending upwardly therefrom, each side rail 28 and mat 22 pair forming a race track segment 30; and, (c) arranging the race track segments 30 by interlocking the mats 22 to form a race track 20, the arrangement being made such that the race track 20 has a perimeter P which is completely bordered by side rails 28.

The method further including:

in (b), a first configuration race track segment 30 including:

a mat 22 having three interlockable sides and one straight side;

a straight side rail 28 disposed along the straight side of mat 22; and, first configuration race track segment 30 positionable along either the perimeter P of race track 20 or in the interior I of race track 20.

The method further including:

in (b), a second configuration race track segment 30 including:

a mat 22 having three interlockable sides and one straight side;

a convex side rail 28 disposed along the straight side of mat 22; and, second configuration race track segment 30 positionable along either the perimeter P of race track 22 or in the interior I of race track 20.

The method further including:

in (b), a third configuration race track segment 30 including:

a mat 22 having two perpendicular interlockable sides and a quarter circle side;

a curved side rail 28 disposed along the quarter circle side of mat 22; and, third configuration race track segment 30 only positionable along the perimeter P of race track 20.

The method further including:

in (b), a fourth configuration race track segment 30 including:

a mat 22 having four interlockable sides and four corners;

a quarter circle side rail 28 which is disposed in one of the corners of mat 22; and, fourth configuration race track segment 30 only positionable in the interior I of race track 20.

The method further including:

in (b), a fifth configuration race track segment 30 including:

a mat 22 being having four interlockable sides;

a straight side rail 28 disposed along a central axis 29 of mat 22; and, fifth configuration race track segment 30 only positionable in the interior I of race track 20.

The method further including:

in (b), side rails 28 removably attached to mats 22.

The method further including:

in (a), each mat 22 having at least one hole 32;

in (b), each side rail 28 having at least one hole 33; and, in (b), a connector 50 received by the at least one hole 32 in mat 22 and the at least one hole 33 in side rail 28, connector 50 removably connecting each side rail 28 to each mat 22.

The method further including:

in (b), each side rail 28 having a first end 29 and an opposite second end 31;

in (b), the first end 29 of each side rail 28 interlockable with an adjacent side rail 28, and the second end 31 of each side rail 28 interlockable with another adjacent side rail 28;

in (b), interlocking the first end 31 of each side rail 28 with an adjacent side rail 28; and, in (b), interlocking the second end 33 of each side rail 28 with another adjacent side rail 28.

The method further including:

top surface 24 having a texture, the texture being one of (1) smooth, (2) roughened, and (3) bumpy.

The method further including:

each mat 22 having a bottom surface 25 having a texture, the texture being one of (1) smooth, (2) roughened, and (3) bumpy; and, the texture of the bottom surface 25 being different from the texture of the top surface 24.

The preferred embodiments of the invention described herein are exemplary and numerous modifications, variations, and rearrangements can be readily envisioned to achieve an equivalent result, all of which are intended to be embraced within the scope of the appended claims.

I claim:

1. A method for constructing a race track for toy vehicles, comprising:

(a) providing a plurality of interlockable mats, each said mat having a top surface;

(b) providing a corresponding plurality of side rails, a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), a first configuration race track segment including:

said mat having three interlockable sides and one straight side;

said side rail being straight and disposed along said straight side of said mat; and, said first configuration race track segment positionable along either said perimeter of said race track or in an interior of said race track.

2. A method for constructing a race track for toy vehicles, comprising:

(a) providing a plurality of interlockable mats, each said mat having a top surface;

(b) providing a corresponding plurality of side rails, a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), a second configuration race track segment including:

said mat having three interlockable sides and one straight side;

said side rail being convex and disposed along said straight side of said mat; and, said second configuration race track segment positionable along either said perimeter of said race track or in an interior of said race track.

3. A method for constructing a race track for toy vehicles, comprising:

(a) providing a plurality of interlockable mats, each said mat having a top surface;

(b) providing a corresponding plurality of side rails a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), a third configuration race track segment including:

said mat having two perpendicular interlockable sides and a quarter circle side;

said side rail being curved and disposed along said quarter circle side of said mat; and, said third configuration race track segment only positionable along said perimeter of said race track.

4. A method for constructing a race track for toy vehicles comprising:

(a) providing a plurality of interlockable mats, each said mat having a top surface;

(b) providing a corresponding plurality of side rails, a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), a fourth configuration race track segment including:

said mat having four interlockable sides and four corners;

said side rail being a quarter circle which is disposed in one of said corners of said mat; and, said fourth configuration race track segment only positionable in an interior of said race track.

5. A method for constructing a race track for toy vehicles, comprising:

(a) providing a plurality of interlockable mats, each said mat having a top surface;

(b) providing a corresponding, plurality of side rails, a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), a fifth configuration race track segment including:

said mat being having four interlockable sides;

said side rail being straight and disposed along a central axis of said mat; and, said fifth configuration race track segment only positionable in an interior of said race track.

6. A method for constructing a race track for toy vehicles, comprising:

(a) providing a plurality of interlockable mats, each said mat having a top surface;

(b) providing a corresponding plurality of side rails, a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), said side rails removably attached to said mats;

in (a), each said mat having at least one hole;

in (b), each said side rail having at least one hole; and, in (b), a connector received by said at least one hole in said mat and said side rail, said connector removably connecting each said side rail to each said mat.

7. A method for constructing a race track for toy vehicles, comprising:

(a) providing a plurality of interlockable mats, each said mat having a top surface;

(b) providing a corresponding plurality of side rails, a said side rail attached to said top surface of each said mat and extending upwardly therefrom, each said side rail and said mat pair forming a race track segment;

(c) arranging said race track segments by interlocking said mats to form a race track, said arrangement being made such that said race track has a perimeter which is completely bordered by said side rails;

in (b), each said side rail having a first end and an opposite second end;

in (b), said first end of each said side rail interlockable with an adjacent side rail, and said second end of each said side rail interlockable with another adjacent side rail;

in (b), interlocking said first end of each said side rail with an adjacent side rail; and, in (b), interlocking said second end of each said side rail with another adjacent side rail.

8. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

a first configuration race track segment including:

said mat having three interlockable sides and one straight side;

said side rail being straight and disposed along said straight side of said mat; and, said first configuration race track segment positionable along either said perimeter of said race track or in an interior of said race track.

9. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

a second configuration race track segment including:

said mat having three interlockable sides and one straight side;

said side rail being convex and disposed along said straight side of said mat; and, said second configuration race track segment positionable along either said perimeter of said race track or in an interior of said race track.

10. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

a third configuration race track segment including:

said mat having two perpendicular interlockable sides and a quarter circle side;

said side rail being curved and disposed along said quarter circle side of said mat; and, said third configuration race track segment only positionable along said perimeter of said race track.

11. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

a fourth configuration race track segment including:

said mat having four interlockable sides and four corners;

said side rail being a quarter circle which is disposed in one of said corners of said mat; and, said fourth configuration race track segment only positionable in an interior of said race track.

12. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

a fifth configuration race track segment including:

said mat having four interlockable sides;

said side rail being straight and disposed along a central axis of said mat; and, said fifth configuration race track segment only positionable in an interior of said race track.

13. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

said side rails removably attached to said mats;

each said mat having at least one hole;

each said side rail having at least one hole; and, a connector received by said at least one hole in said mat and said side rail, said connector removably connecting each said side rail to each said mat.

14. The race track according to claim 13, further including:

said holes in said mat and said side rail having a first diameter;

said connector including a first member having a hollow cylindrical body having female threads, said body having an outside second diameter approximately equal to said first diameter of said holes in said mat and said side rail, and said first member having a closed end having a first flange having a third diameter greater than said first diameter;

said connector including a second member having male threads which selectively engage said female threads of said first member, said second member having a second flange having a fourth diameter greater than said first diameter; and, wherein said first member may be inserted through said holes of said side rail and said mat, and said male and female threads engaged and tightened so that said first and second flanges abut said side mat and said side rail respectively.

15. A race track for toy vehicles, comprising:

a plurality of interlocking mats, each said mat having a top surface;

a side rail attached to said top surface of each said mat and extending upwardly therefrom, each said side rail and said mat pair forming a race track segment;

said race track segments arranged so that said race track has a perimeter which is bordered by said side rails, wherein when the toy vehicle contacts a said side rail the vehicle is deflected away from said side rail;

said side rails removably attached to said mats;

each said side rail having at least one hole;

each said mat having at least one hole;

a connector received by said holes in said mat and said side rail, said connector connecting each said side rail to each said mat; and, said top surface having a texture, said texture being one of (1) smooth, (2) roughened, and (3) bumpy.

* * * * *